US007902470B2

(12) United States Patent
Hosaka

(10) Patent No.: US 7,902,470 B2
(45) Date of Patent: Mar. 8, 2011

(54) DECORATIVE KEY SHEET FOR PUSHBUTTON SWITCHES

(75) Inventor: Junko Hosaka, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 440 days.

(21) Appl. No.: 12/071,329

(22) Filed: Feb. 20, 2008

(65) Prior Publication Data

US 2008/0206521 A1 Aug. 28, 2008

(30) Foreign Application Priority Data

Feb. 21, 2007 (JP) ..... 2007-041468

(51) Int. Cl.
*H01H 9/00* (2006.01)

(52) U.S. Cl. ..... 200/314

(58) Field of Classification Search ..... 200/308, 200/314, 511, 512, 5 A
See application file for complete search history.

(56) References Cited

U.S. PATENT DOCUMENTS

2005/0221058 A1* 10/2005 Shigeta ..... 428/174
2006/0017693 A1* 1/2006 Nishimura ..... 345/156

FOREIGN PATENT DOCUMENTS

| | | | |
|---|---|---|---|
| JP | 06-305063 | A | 11/1994 |
| JP | 2002-008476 | A | 1/2002 |
| JP | 2003-109450 | A | 4/2003 |
| JP | 2005-111865 | A | 4/2005 |
| JP | 2006-156333 | A | 6/2006 |
| JP | 2006-185699 | A | 7/2006 |

* cited by examiner

*Primary Examiner* — Edwin A. Leon
*Assistant Examiner* — Vanessa Girardi
(74) *Attorney, Agent, or Firm* — Cermak Nakajima LLP; Tomoko Nakajima

(57) ABSTRACT

Disclosed is a decorative key sheet of high visibility which is superior in terms of design and helps to maintain a quality appearance, which enables an operator to perform input operation safely, and which is of a thin type. The decorative key sheet is formed as a thin sheet including an operation plate, a film sheet, and a base sheet. A fine asperity pattern is provided on a front surface side of an operation plate. Further, a light reflection layer enhancing the visibility of the fine asperity pattern is provided on a back surface of the operation plate. The operation plate is transparent. The fine asperity pattern is formed on a resin layer.

16 Claims, 11 Drawing Sheets

DECORATIVE KEY SHEET FOR PUSHBUTTON SWITCHES

BACKGROUND OF THE INVENTION

1. Field of the Invention

The present invention relates to a decorative key sheet for pushbutton switches for use in an operating portion of an electronic instrument such as a mobile information terminal, a PDA, an AV instrument, various remote control units, or various keyboards.

2. Description of the Related Art

A reduction in size and thickness of electronic instruments such as mobile information terminals and PDAs is under way, and there is a demand for a thin type input component such as a key sheet for those instruments allowing realization of a reduction in thickness of electronic instruments. On the other hand, various decorations for an enhancement in design value are imparted to key sheets so as to achieve product differentiation thereof and to give a quality appearance thereto; among such decorations is a hairline pattern with a metallic luster. In this context, thin key sheets with a hairline pattern have been realized by the following techniques.

For example, by using the techniques as disclosed in JP 2002-008476 A and JP 2006-156333 A, which utilize a metal plate such as an aluminum plate or a stainless steel plate, it is possible to impart a fine asperity pattern to the surface of a metal plate, thereby realizing a key sheet of a hairline pattern with a metallic luster.

Further, as disclosed in JP 06-305063 A and JP 2005-111865 A, by providing a fine asperity hairline pattern on the surface of a resin sheet and covering the surface with a metal thin film layer, a metallic coating layer or the like, it is possible to realize a key sheet of a hairline pattern with a metallic luster.

Further, according to the techniques disclosed in JP 2003-109450 A and JP 2006-185699 A, a fine asperity hairline pattern is formed on the back surface of a transparent member, and a metal thin film layer, a metallic coating layer or the like is provided on the hairline pattern surface, whereby it is possible to realize a key sheet of a hairline pattern with a metallic luster.

However, while the techniques using a metal plate as disclosed in JP 2002-008476 A and JP 2006-156333 A provide high durability for the asperity pattern and make it possible to maintain the metallic luster, in the case of a component to be touched with the hand such as a key sheet, there is a fear of the operator being injured by the forward end portion or edge portion of the metal plate, so it is necessary to smoothen the forward end portion and edge portion by polishing, etching or the like or cover the forward end portion and edge portion with a polymer material. Thus, the production takes a lot of time and effort, resulting in a rather high cost.

In the resin surface decorating techniques as disclosed in JP 06-305063 A and JP 2005-111865 A, it is possible to achieve an improvement in terms of safety as compared with the techniques using a metal plate; however, the metal thin film layer, the metallic coating film layer or the like is subject to wear through touching with the hand; further, they are easily separated from the resin, so it is rather difficult to maintain the quality appearance. Further, covering the fine asperity surface with a metal thin film layer, a metallic coating film layer or the like results in the recessed portions of the pattern being filled up, which makes the hairline pattern rather inconspicuous, thus making it rather difficult to attain the desired design value.

In the techniques as disclosed in JP 2003-109450 A and JP 2006-185699 A, in which the back surface of a transparent member is decorated, it is possible to prevent wear and separation of the metal thin film layer, the metallic coating film layer or the like; however, it is rather difficult to visually recognize the fine asperity hairline pattern through the transparent member. When, in order to enhance the visibility, the surface of the transparent member is formed as a smooth surface, the surface of the transparent member becomes subject to staining through touching with the hand, etc., thereby impairing the quality appearance.

SUMMARY OF THE INVENTION

The present invention has been made in view of the above-mentioned problems in the prior art. It is accordingly an object of the present invention to provide a decorative key sheet for pushbutton switches which provides high visibility, which is superior in terms of design, and which helps to maintain a quality appearance. Another object of the present invention is to provide a decorative key sheet for pushbutton switches which enables the operator to safely perform input operation. Still another object of the present invention is to provide a thin type decorative key sheet for pushbutton switches.

In order to achieve the above-mentioned object, the present invention has the following structure. That is, the present invention provides a decorative key sheet for pushbutton switches including: a fine asperity pattern due to an asperity surface portion on an operating surface side of a light transmitting sheet; and a decorative auxiliary layer enhancing a visibility of the fine asperity pattern on a surface on the side of the light transmitting sheet opposite to the operating surface.

According to the present invention, a fine asperity pattern is provided on the operating surface side of a light transmitting sheet, so the design of the fine asperity pattern can be visually recognized with clarity. Further, the fingerprint, sebum or the like of the finger of the operator is not easily allowed to adhere to the asperity surface portion constituting the fine asperity pattern, thus making it possible to suppress deterioration in quality due to staining. Further, a decorative auxiliary layer is provided on the side (back side) opposite to the operating surface of the light transmitting sheet, so the operator's hand or the like does not easily come into contact with the decorative auxiliary layer, thus making it possible to prevent wear and separation of the decorative auxiliary layer. Further, due to the light transmission property of the light transmitting sheet and the provision of the decorative auxiliary sheet on the back side of the light transmitting sheet, the light transmitted through the fine asperity pattern is reflected by the decorative auxiliary layer and further passes through the fine asperity pattern before reaching the eye. Thus, the color, luster, texture, etc. of the decorative auxiliary layer are emphasized through the fine asperity pattern, whereby it is possible to visually recognize to a sufficient degree the color, luster, and texture of the decorative auxiliary layer, and the fine asperity pattern becomes easier to see, thus making it possible to realize a novel design of a quality appearance.

It is possible to provide a decorative key sheet for pushbutton switches which is equipped with a light transmitting resin layer on the operating surface side surface of a light transmitting sheet and which has the fine asperity pattern on the outer surface of the resin layer. Since a light transmitting resin layer is provided on the operating surface side surface of the light transmitting sheet, and the fine asperity pattern is provided on the outer surface of the resin layer, the design of the fine asperity pattern can be visually recognized with clarity. Further, adhesion of the fingerprint, sebum or the like of the finger of the operator does not easily occur, so it is possible to suppress deterioration in quality due to staining. Further, it is possible to realize a decorative key sheet which is superior in terms of design and which helps to maintain a quality appearance. Further, the resin layer can be made hard, and the light transmitting sheet situated on the inner side of the resin layer can be formed of soft resin, thus widening the range of material selection.

It is possible to provide a decorative key sheet for pushbutton switches which has a fine asperity pattern on the operating surface side outer surface of a light transmitting sheet. Since the decorative key sheet for pushbutton switches has a fine asperity pattern on the operating surface side outer surface of the light transmitting sheet, the design of the fine asperity pattern can be visually recognized with clarity. Further, adhesion of the fingerprint, sebum or the like of the finger of the operator does not easily occur, so it is possible to suppress deterioration in quality due to staining. Further, it is possible to realize a key sheet for pushbutton switches which is superior in terms of design and which helps to maintain a quality appearance. Further, it is possible to omit the light transmitting resin layer mentioned above. Thus, the decorative key sheet for pushbutton switches can be produced easily, and it is possible to achieve a reduction in production cost.

The decorative auxiliary layer may be formed as a light reflecting layer having a metallic luster. Due to the synergistic effect of the formation of the decorative auxiliary layer as a light reflecting layer with a metallic luster and of diffusion of light at the asperity surface portion of the fine asperity pattern, it is possible to realize a metallic hairline pattern which provides enhanced visibility and which is superior in terms of design.

Further, according to the present invention, it is possible to provide decorative key sheets for pushbutton switches with the following further restrictive features. First, it is possible to provide a decorative key sheet whose light transmitting sheet is an operation plate provided with a partition groove defining a depressing operation member allowing depressing displacement and which is equipped with a film sheet provided with a protrusion swelling toward the partition groove from the side opposite to the operating surface of the operation plate.

A fine asperity pattern is provided on the operating surface side outer surface of the operation plate, so the design of the fine asperity pattern can be visually recognized with clarity. Further, the fingerprint, sebum or the like of the finger of the operator does not easily adhere to the asperity surface portion constituting the fine asperity pattern, and it is possible to suppress deterioration in quality due to staining. Further, on the side (back side) opposite to the operating surface of the operation plate, there is provided a decorative auxiliary layer enhancing the visibility of the fine asperity pattern, so the operator's hand or the like does not come into contact with the decorative auxiliary layer, thus making it possible to prevent wear and separation of the decorative auxiliary layer. Further, since the operation plate allows transmission of light, the color, luster, texture, etc. of the decorative auxiliary layer on the back side can be visually recognized to a sufficient degree through the fine asperity pattern, thus making it possible to realize a novel design of a quality appearance. In addition to those advantages, due to the provision of the film sheet provided with the protrusion swelling toward the partition groove from the back side of the operation plate, it is possible, owing to the film sheet, to prevent a nail, fingertip or the like from getting deep into the partition groove to suffer injury. Further, the decorative key sheet can be formed as a thin key sheet while including the operation plate and the film sheet.

In the first decorative key sheet for pushbutton switches described above, the protrusion may protrude from the outer surface of the operation plate. Thus, the position of the partition groove can be ascertained by the configuration of the protrusion, making it possible to easily identify the region of the depressing operation member by the touch. Thus, it is possible to prevent erroneous input. Further, it is possible to prevent a nail, fingertip or the like from entering the partition groove, thus providing a decorative key sheet for pushbutton switches which can be safely operated by the operator.

In the above-mentioned first decorative key sheet for pushbutton switches, it is possible to further provide an elastic sheet formed of a rubber-like elastic material on a back surface of the film sheet. The elastic sheet can provide a restoring force for the depressing operation member when depressing operation is performed thereon.

In the above-mentioned first decorative key sheet for pushbutton switches, the protrusion may be formed as a solid portion formed of a rubber-like elastic material. Since it is formed as a solid portion, the protrusion rebounds from within when depressed with a fingertip at the time of depressing operation, thus preventing denting of the protrusion. Further, since the elastic sheet and the solid portion filling the interior of the protrusion are both formed of a rubber-like elastic material, the elastic sheet and the solid portion can be formed simultaneously. Thus, their production is facilitated, making it possible to easily realize their integration with the operation plate.

In the above-mentioned first decorative key sheet for pushbutton switches, the partition groove may be formed in an annular configuration, thus providing a depressing operation member defined by the annular partition groove. Due to the provision of such a depressing operation member, it is possible to realize a key sheet of a novel design. Further, the depression load deforming the protrusion situated within the partition groove is smaller than the depression load bending the operation plate, so, as compared, for example, with other depressing operation member surrounded on three sides by a partition groove, the depressing operation member defined by the annular partition groove helps to achieve a reduction in depression load.

In the above-mentioned first decorative key sheet for pushbutton switches, it is possible to provide a gap between the protrusion and the side surface of the partition groove. When there is a gap, the protrusion and the depressing operation member are separated from each other, so the deformation of the protrusion when the depressing operation member is depressed can be diminished. Thus, the requisite load for deforming the protrusion is diminished, and the depression load on the depressing operation member can be reduced.

In the above-mentioned first decorative key sheet for pushbutton switches, in the case in which an elastic sheet is provided, it is possible to provide a recess between adjacent depressing operation members. Since the elastic sheet is provided with a recess at a position between the adjacent depressing operation members, the portion of the elastic sheet between the depressing operation members can be made thin. Thus, when the depressing operation member is depressed, the elastic sheet can easily undergo deformation, thus making it possible to diminish the depression load for the depressing operation member.

As a second decorative key sheet for pushbutton switches with restrictive features, there is provided a decorative key sheet for pushbutton switches which has a base sheet including a key top and a resin film, whose light transmitting sheet is a frame sheet arranged on the base sheet side by side with the key top, and which is provided with a print bonding layer formed as a print layer and formed of a cured body brought into contact with one of the key top, the frame sheet, and the base sheet in one of a softened state and a molten state.

A fine asperity pattern is provided on the operating surface side of the frame sheet, so the design of the fine asperity pattern can be visually recognized with clarity. Further, the fingerprint, sebum or the like of the finger of the operator is not easily allowed to adhere to the asperity surface portion constituting the fine asperity pattern, thus making it possible to suppress deterioration in quality due to staining. Further, there is provided, on the side (back side) opposite to the operating surface side of the frame sheet, a decorative auxiliary layer enhancing the visibility of the fine asperity pattern, so it is possible to prevent wear and separation of the decorative auxiliary layer through contact with the operator's hand or the like. Further, the frame sheet allows transmission of light, so the color, luster, texture, etc. of the decorative auxiliary layer on the back side can be visually recognized to a sufficient degree through the fine asperity pattern, thus making it possible to realize a novel design of a quality appearance. In addition to those advantages, the decorative key sheet can be made thin due to the provision of the base sheet formed of a resin film, the key top arranged on the base sheet, and the print bonding layer formed as a print layer and formed of a cured body brought into contact with one of the key top, the frame sheet, and the base sheet in one of a softened state and a molten state. Further, it is possible to provide a decorative key sheet having a print bonding layer in which the fixation positions for the key top and the base sheet and the coating thickness are controlled with high accuracy. That is, it is possible to provide a thin key sheet in which, as compared with the conventional case in which bonding is effected with adhesive dripped, for example, on the bottom surface of the key top, there is involved less variation in the position and area of the adhesion layer, with the key top being firmly fixed in position so as not to be easily detached. In particular, due to the provision of the frame sheet between the key tops, it is possible to provide a thin decorative key sheet in which a nail tip does not easily enter the gap between the key top and the base sheet and in which the key top is not easily detached.

In the second decorative key sheet for pushbutton switches, the print bonding layer may exhibit, between the base sheet and the key top, a side surface which is substantially flush with the side surface of the key top. Since the print bonding layer forms a side surface substantially flush with the side surface of the key top between the base sheet and the key top, no gap exists in the boundary between the key top and the base sheet, thus making it possible to firmly fix the key top to the base sheet. Thus, a nail tip or the like does not easily get caught therein, thus making the key top relatively free from detachment. Here, the expression: "substantially flush" means that the side surface of the print bonding layer is recessed or protrudes from the side surface of the key top by ±0.5 mm or less.

In the second decorative key sheet for pushbutton switches, the print bonding layer may be formed on the bottom surface of the frame sheet except for the outer edge side thereof adjacent to the key top. Since the print bonding layer is formed on the bottom surface of the frame sheet except for the outer edge side thereof adjacent to the key top, there is generated a gap devoid of the print bonding layer on the outer edge side of the frame sheet adjacent to the key top, and this portion serves as a non-constrained region when the key top is depressed. Thus, it is possible to reliably perform depressing operation on the key top. That is, due to the presence of the non-restrained region around the key top, in the base sheet supporting the key top, the region not constrained by the print bonding layer expands by an amount corresponding to the gap portion, making the base sheet subject to deflection. Thus, the depression stroke for the key top can be elongated, so it is possible to provide a decorative key sheet which, even in the case of a thin type, allows correct key input operation.

In the decorative key sheet for pushbutton switches of the present invention, the design of the fine asperity pattern can be visually recognized with clarity. Further, adhesion of the fingerprint, sebum or the like of the finger of the operator does not easily occur, thus making it possible to suppress deterioration in quality due to staining. Further, it is possible to realize a decorative key sheet for pushbutton switches which is superior in terms of design and which helps to maintain a quality appearance.

Further, according to the present invention, it is possible to provide a decorative key sheet for pushbutton switches which enables the operator to perform input operation safely and reliably. Further, according to the present invention, there is provided a thin decorative key sheet for pushbutton switches which incurs no such problem as detachment of the key top.

The above description of the present invention should not be construed restrictively; the advantages, features, and uses of this invention will become further clarified through the following description given with reference to the accompanying drawings. Further, it should be understood that all appropriate modifications made without departing from the gist of this invention are to be covered by the scope of this invention.

DETAILED DESCRIPTION OF THE PREFERRED EMBODIMENTS

Figure 1:
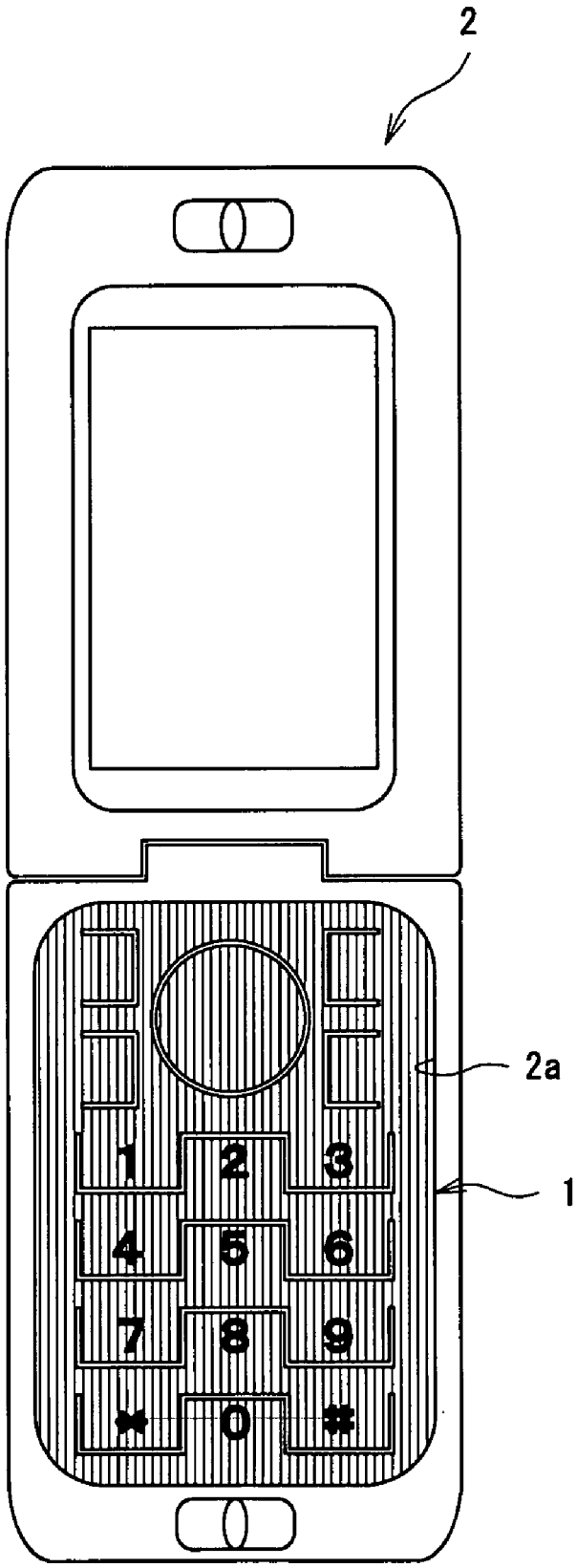
FIG. 1 is an external view of a cellular phone equipped with a decorative key sheet for pushbutton switches according to the present invention.

In the following, embodiments of the decorative key sheet for pushbutton switches of the present invention (hereinafter simply referred to as "decorative key sheet") will be described with reference to the drawings. The reference numerals used in the drawings indicate portions and components. A redundant description of the members, materials, constructions, manufacturing methods, and effects common to the embodiments will be omitted.

Figure 2:
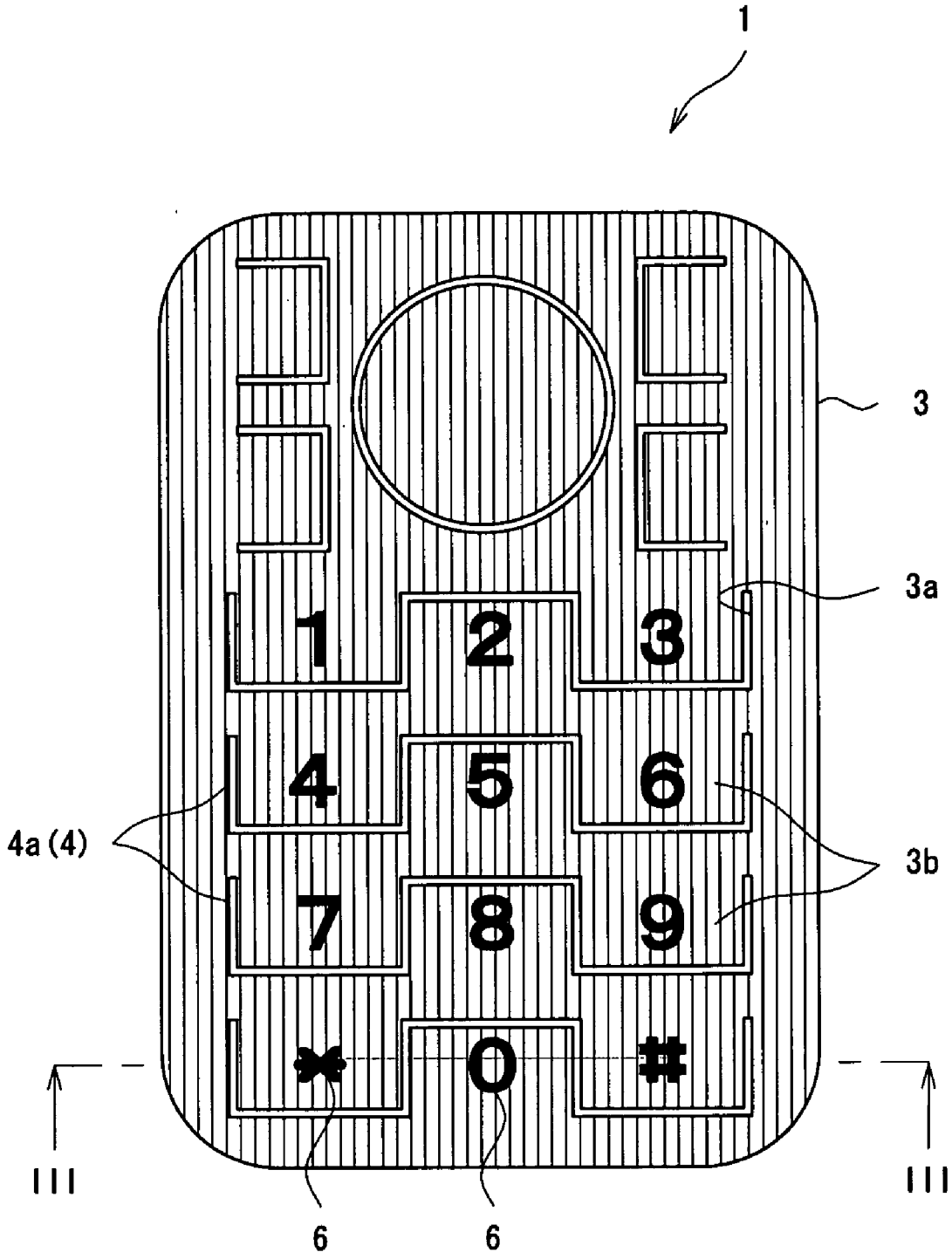
FIG. 2 is a plan view of a decorative key sheet for pushbutton switches according to a first embodiment of the present invention.
Figure 3:
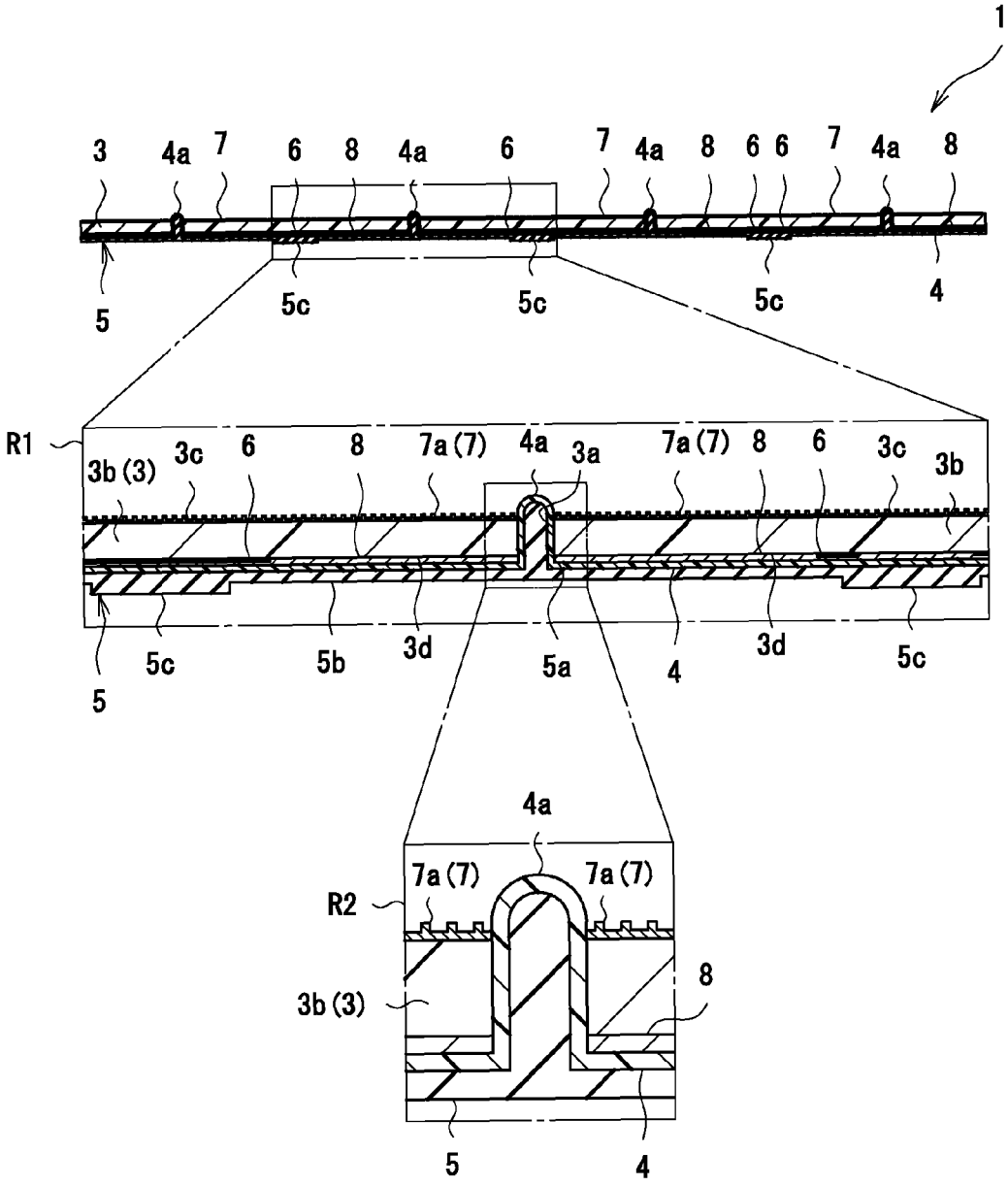
FIG. 3 is a sectional view taken along the line III-III of FIG. 2.

First Embodiment (FIGS. 1 Through 3)

FIGS. 1 through 3 show a decorative key sheet 1 according to a first embodiment. FIG. 1 is an external view of a cellular phone 2 equipped with the decorative key sheet 1, FIG. 2 is a plan view of the decorative key sheet 1, and FIG. 3 is a sectional view of the decorative key sheet 1. The decorative key sheet 1 of the first embodiment is used in the cellular phone 2 shown in FIG. 1 so as to be exposed through an opening 2*a* with no partition frame. Further, it is equipped with an operation plate 3 formed as a "light transmitting sheet", a film sheet 4, and an elastic sheet 5.

The operation plate 3 is a member functioning as an operation plate for pushbutton switches, and also corresponds to a key top of the type on which input operation is effected by depression thereof. The operation plate 3 is formed of a single plate made up of resin; in this single plate, there are provided, in a square-wave-like manner, partition grooves 3*a* extending through the thickness of the plate; the portions defined by the partition grooves 3*a* constitute depressing operation members 3*b*, which can be deformed at the time of input operation. As shown in FIGS. 1 and 2, the partition grooves 3*a* are formed in a square-wave-like configuration; in the case, for example, of the depressing operation member 3*b* with which a display portion 6 representing the symbol "*" can be visually recognized, the partitioning is effected downwardly as seen in the drawing, and, in the case of the depressing operation member 3*b* with which a display portion 6 representing the figure "0" can be visually recognized, the partitioning is effected upwardly.

A transparent resin layer 7 is provided on the operating surface side surface 3*c* of the operation plate 3; the outer surface of the resin layer 7, that is, the outer exposed surface thereof is provided with a fine asperity pattern and has an asperity surface portion 7*a*. It is desirable for the interval of the recesses of the asperity surface portion 7*a* to range from 10 μm to 500 μm, and for the depth of the recesses to range from 1 μm to 200 μm; it is more desirable for the depth of the recesses to range from 5 μm to 30 μm. When the interval of the recesses is less than 10 μm, the production of the asperity pattern becomes rather difficult, and when it exceeds 500 μm, the asperity pattern becomes rather coarse, resulting in a poor outward appearance. When the depth of the recesses is less than 1 μm, the fine asperity pattern is rather inconspicuous, whereas when it exceeds 200 μm, the production of the asperity pattern becomes rather difficult. Due to the asperity surface portion 7*a*, formed as described above, it is possible to visually recognize a so-called hairline type design.

On the surface on the opposite side of the operating surface of the operation plate 3, that is, on the back surface 3*d* of the operation plate 3, there is provided a light reflection layer 8 as a "decorative auxiliary layer". Synergistically with the asperity surface portion 7*a*, the light reflection layer 8 imparts tone and luster to the fine asperity pattern, thereby further improving the texture of the fine asperity pattern. Further, it helps to obtain a design of a higher quality appearance. Between the light reflection layer 8 and the back surfaces 3*d* of the depressing operation members 3*b*, the display portions 6 representing symbols, figures, etc. are formed by printing.

The film sheet 4 is a member which enters the partition grooves 3*a* formed in the operation plate 3 from the back side of the operation plate 3 to stop the partition grooves 3*a*. That is, the film sheet 4, which is formed of a single sheet, is fixed to the back surface 3*d* of the operation plate 3 by an adhesive layer (not shown), and has protrusions 4*a* swelling from the back surface 3*d* side toward the front surface 3*c* side through the partition grooves 3*a* to thereby stop the partition grooves 3*a*. The distal ends of the protrusions 4*a* protrude from the surface 3*c* of the operation plate 3.

The elastic sheet 5 is situated on the back surface of the film sheet 4 to form a base portion 5*b*, and imparts a rubber-like elasticity to the entire decorative key sheet 1. Further, the elastic sheet 5 forms protruding portions 5*a* and pusher portions 5*c*. The protruding portions 5*a* are formed so as to fill the inner spaces of the protrusions 4*a* of the film sheet 4 as "solid portions", and the base portion 5*b* integrally connects a plurality of protruding portions 5*a*. In correspondence with the depressing operation members 3*b*, the base portion 5*b* is provided with the pusher portions 5*c* for depressing contact switches (not shown).

Here, the materials of the components of the decorative key sheet 1 will be described.

The operation plate 3 is preferably formed of resin, glass or the like; of those, the resin may be a hard resin transmitting light and exhibiting high rigidity, preferably being transparent. Examples of the resin to be used include a polypropylene resin, a polystyrene resin, a polycarbonate resin, a polyester resin, an acrylic resin, a polyamide resin, and a polyimide resin. The thickness of the operation plate 3 may range from 50 μm to 2000 μm. It is also possible to use a soft resin which will be deflected when held at one end. This is because it is not necessary for the operation plate 3, which is integrally stacked together with the film sheet 4, to be hard as long as the film sheet 4 retains a fixed form. By adopting a soft resin, the decorative key sheet 1 can be made softer.

As the material of the resin layer 7 provided on the surface 3*c* of the operation plate 3, there is used a light transmitting hard resin; in particular, there is preferably used a transparent resin as in this embodiment. By adopting a resin whose surface hardness is not lower than H as defined in JIS K 5600-5-4: 1999, it is possible to obtain a material superior in terms of flaw resistance. Examples of such a resin include an acrylic resin, a urethane resin, an epoxy resin, and a vinyl acetate resin. From the viewpoint of production as described below, it is desirable to adopt a thermosetting resin or a photo-setting resin. Since the resin layer 7 is formed of a hard resin superior in flaw resistance, any fine asperity pattern imparted to the outer surface thereof is not flawed. Further, since the resin layer 7 is formed of a hard resin, the operation plate 3 situated inside thereof may be formed of a soft resin.

It is desirable for the material of the "decorative auxiliary layer" provided on the back surface 3*d* of the operation plate 3 to be one capable of expression of a design of enhanced visibility which makes the fine asperity pattern provided on the surface 3*c* side of the operation plate 3 easier to see. That is, it is possible to use a material which helps to enhance the visibility for the refraction, scattering, interference, etc. of light generated by the fine asperity pattern. For example, it is preferable to adopt a material providing a metallic luster such as a metal thin film, or a material such as a polymer coating film providing tone, e.g., metallic tone or black tone. Examples of the material of the metal thin film include aluminum, chromium, copper, germanium, gold, indium, iron, lead, magnesium, nickel, palladium, platinum, silver, tin, titanium, and zinc. Specifically, it is desirable to adopt aluminum, silver, indium, magnesium, tin, etc., which exhibit low melting point and easily allow thin film formation. Preferable examples of the polymer coating film material include, a urethane resin, an acrylic resin, an ester resin, a vinyl acetate resin, a vinyl chloride resin, and an epoxy resin, each containing pigment, pearl pigment, metal powder or the like.

As the material of the film sheet 4, it is possible to use, for example, a resin film formed of a thermoplastic resin endowed with both flexibility and wear resistance and allowing formation of the protrusions. Examples of the resin to be used include a polyolefin resin, a polyester resin, a polyurethane resin, a polyamide resin, and a soft polyvinyl chloride resin. When the thickness of the film sheet 4 ranges from 10 μm to 200 μm, it is possible to form the protrusions without incurring breakage. However, depending on the material of the operation plate 3, it is possible to change the range of selection for the material of the film sheet 4. When the operation plate 3 is formed of a hard resin providing such a fixed form as will not be deflected when held at one end, it is possible to use a soft resin providing no such fixed form; on the other hand, when the operation plate 3 is formed of a soft resin providing no such fixed form, it is necessary for the film sheet 4 to be formed of a hard resin providing a fixed form.

The elastic sheet 5 is formed of a thin rubber-like elastic body; it is preferably formed of a thermosetting elastomer or a thermoplastic elastomer exhibiting high resiliency. Examples of the material of the elastic sheet include silicone rubber, isoprene rubber, ethylene propylene rubber, butadiene rubber, chloroprene rubber, natural rubber, styrene-based thermoplastic elastomer, ester-based thermoplastic elastomer, urethane-based thermoplastic elastomer, olefin-based thermoplastic elastomer, amide-based thermoplastic elastomer, butadiene-based thermoplastic elastomer, ethylene/vinyl-acetate-based thermoplastic elastomer, fluorine-based thermoplastic elastomer, isoprene-based thermoplastic elastomer, and chlorinated polyethylene-based thermoplastic elastomer. Of those rubber-like elastic materials, silicone rubber is preferable in view of its low temperature dependency; from the viewpoint of durability, styrene type thermoplastic elastomer and ester type thermoplastic elastomer are preferable.

An example of the method of manufacturing the decorative key sheet 1 will be described. First, the operation plate 3 formed of transparent resin is formed by injection molding. At this time, the partition grooves 3*a* extending through the thickness thereof are formed by cavities in the mold for injection molding. The operating surface side of the operation plate 3 is opposed to a mold with a fine asperity pattern formed thereon, and a liquid photo-setting resin is injected between the operation plate 3 and the mold, and then light is applied from the operation plate 3 side to cure the photo-setting resin before removing the mold, thereby obtaining the operation plate 3 whose surface 3*c* has on the operating surface side the resin layer 7 with the fine asperity pattern formed thereon. The display portions 6 are formed by printing on the back surface 3*d* of the operation plate 3, and then the light reflection layer 8 is formed by forming a metal thin film by dry plating. Further, an adhesive layer formed of a hot melt adhesive is applied to the light reflection layer 8. Then, the operation plate 3 is inserted into the mold for forming the film sheet 4 such that the resin layer 7 on the surface 3*c* of the operation plate 3 is in contact with the mold surface, and then the film sheet 4 is placed on the back surface 3*d* side of the operation plate 3 before closing the mold to form the film sheet 4 by heat embossing. At this time, the protrusions 4*a* extended into the partition grooves 3*a* by protrusions in the mold are formed on the film sheet 4, and the back surface 3*d* of the operation plate 3 and the film sheet 4 are fixed to each other. Finally, the operation plate 3 is inserted into the mold for forming the elastic sheet 5 such that the resin layer 7 on the surface 3*c* of the operation plate 3 is in contact with the mold surface, and then the rubber-like elastic member is placed on the film sheet 4 before closing the mold to thereby form the elastic sheet 5 by compression molding. At this time, the protruding portions 5*a* are formed in the protrusions 4*a*. In this way, it is possible to obtain the decorative key sheet 1.

In forming the fine asperity pattern, it is also possible to use, instead of a mold, a metal plate or an emboss roll having an asperity pattern on the surface thereof; the metal plate or the emboss roll is opposed to the operation plate 3, and a liquid thermosetting resin or a photo-setting resin is injected between them and cured, thereby obtaining the fine asperity pattern.

The effects of the decorative key sheet 1 of this embodiment will be described. The decorative key sheet 1, which includes the operation plate 3, the film sheet 4, and the elastic sheet 5, is formed as a thin sheet; in addition, due to the provision of the fine asperity pattern on the surface 3*c* side of the operation plate 3, the design of the fine asperity pattern can be visually recognized with clarity. Further, the fingerprint, sebum or the like of the finger of the operator does not easily adhere to the asperity surface portion 7*a* of the resin layer 7 constituting the fine asperity pattern, thus making it possible to suppress deterioration in quality due to staining. Further, since the light reflection layer 8 enhancing the visibility of the fine asperity pattern is provided on the back surface 3*d* of the operation plate 3, it is possible to prevent wear and separation of the light reflection layer 8 as a result of coming into contact with the operator's hand or the like. Further, since the operation plate 3 is transparent, it is possible to visually recognize to a sufficient degree the metallic luster of the light reflection layer 8 on the back surface 3*d* side thereof through the fine asperity pattern, thus making it possible to realize a novel design of quality appearance.

Since the resin layer 7 has on its outer surface the fine asperity pattern, the operator does not easily suffer injury when touching the asperity surface portion 7*a* of the fine asperity pattern by hand, thus enabling the operator to perform input operation safely.

Due to the provision of the light reflection layer 8 having a metallic luster as the "decorative auxiliary layer", the fine asperity pattern is easy to see and, synergistically with the light diffusion at the asperity surface portion 7*a* of the fine asperity pattern, it is possible to realize a metallic hairline pattern.

Since the protrusions 4*a* of the film sheet 4 protrude from the surface 3*c* of the operation plate 3, it is possible to ascertain the positions of the partition grooves 3*a* from the configuration of the protrusions, making it possible to easily identify the regions of the depressing operation members 3*b* by the touch. Thus, it is possible to prevent erroneous input. Further, it is possible to prevent a nail, fingertip or the like from entering the partition grooves 3*a*.

Since the elastic sheet 5 formed of a rubber-like elastic material is provided on the back surface of the film sheet 4, the elastic sheet 5 can be endowed with a restoring force when depressing operation is performed on the depressing operation members 3*b*.

Since the interiors of the protrusions 4*a* of the film sheet 4 are formed as the "solid portions" of the protruding portions 5 formed of a rubber-like elastic material, when the protrusions 4*a* are depressed with the fingertip at the time of depressing operation, the protruding portions 5*a* rebound from within the protrusions 4*a*, making it possible to prevent denting of the protrusions 4*a*. Further, since the elastic sheet 5 and the protruding portions 5*a* can be formed simultaneously, the production is facilitated, making it possible to easily realize integration with the operation plate 3.

Since the partition grooves 3*a* of the operation plate 3 are formed in an annular configuration, and the depressing operation members 3*b* are defined by the annular partition grooves 3*a*, it is possible to realize the decorative key sheet 1 of a novel design. Further, the depression load for deforming the protrusions 4*a* situated in the grooves of the partition grooves 3*a* is smaller than the depression load for bending the operation plate 3, so, as compared, for example, with other depressing operation members 3*b* surrounded on three sides by the partition grooves 3*a*, the depression load for the depressing operation members 3*b* defined by the annular partition grooves 3*a* can be made smaller.

Figure 4:
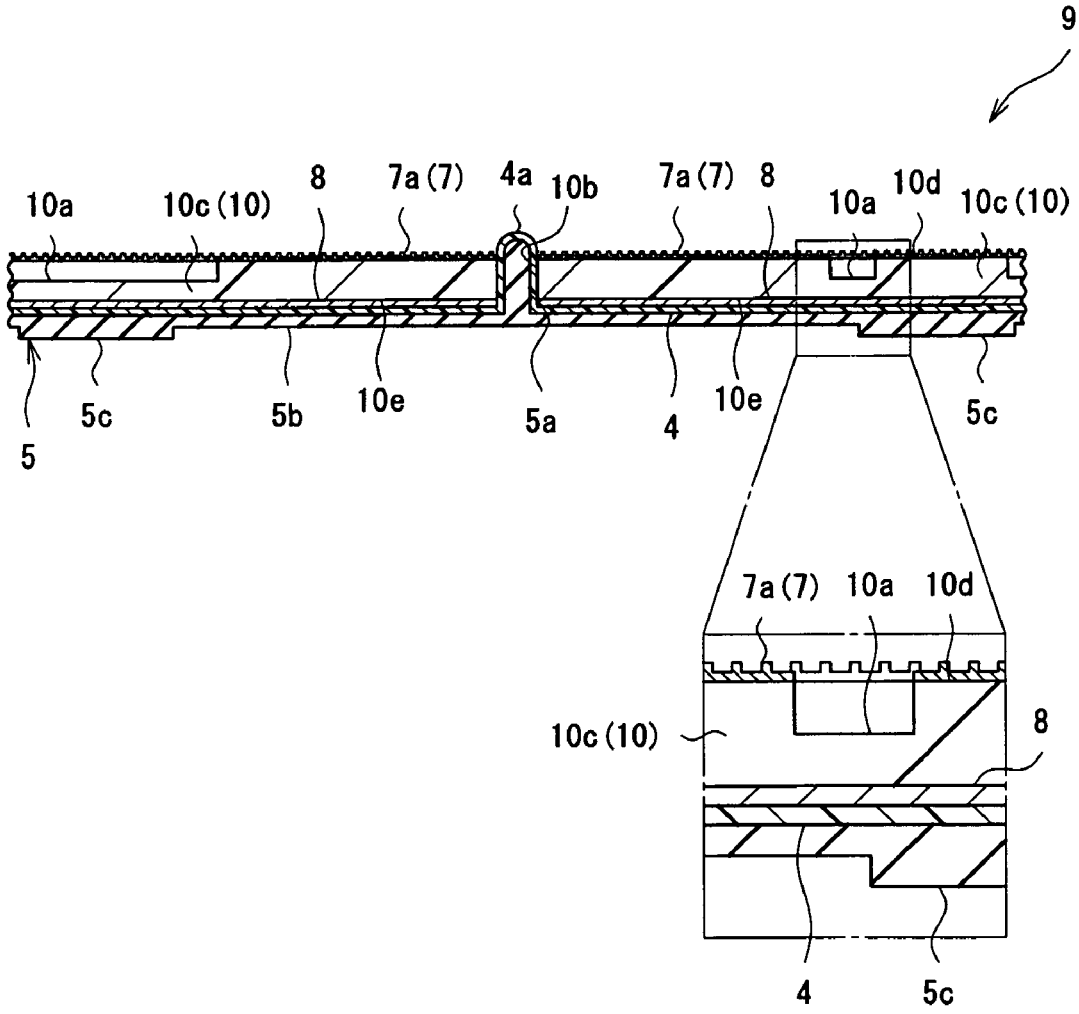
FIG. 4 is a sectional view, corresponding to FIG. 3, of a decorative key sheet for pushbutton switches according to a first modification of the first embodiment of the present invention.

First Modification of First Embodiment (FIG. 4)

While in the above-mentioned example of the decorative key sheet 1, the display portions 6 are formed by printing on the back surface 3*d* of the operation plate 3, as shown in FIG. 4, in a decorative key sheet 9 according to a first modification, it is also possible to form recesses 10*a* representing display portions in surfaces 10*d* of depressing operation members 10*c* defined by partition grooves 10*b* of an operation plate 10. As in the case of the operation plate 3, the light reflection layer 8 is provided on a back surface 10*e* of the operation plate 10. With this construction also, the operator can visually recognize the display portions. The display portions may be formed as through-holes extending through the thickness of the operation plate.

Figure 5:
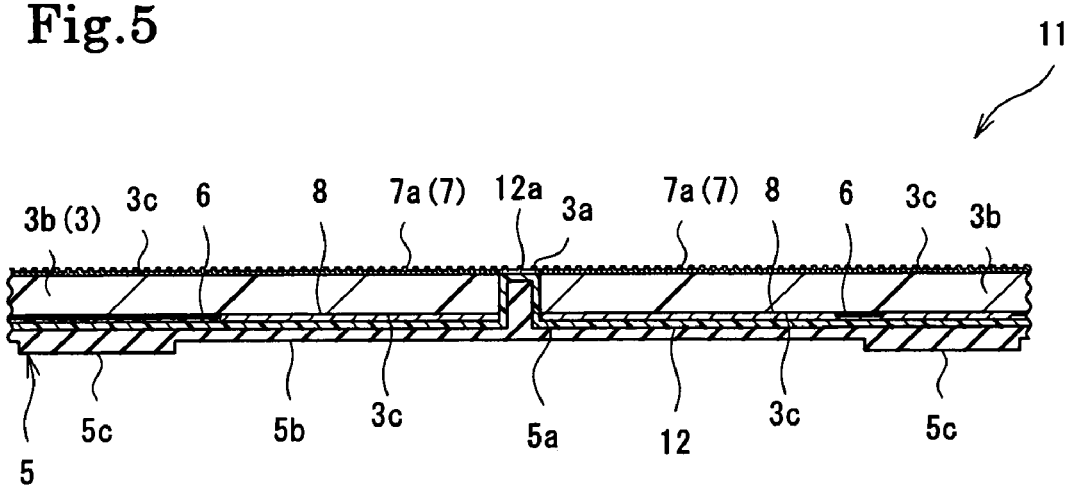
FIG. 5 is a sectional view, corresponding to FIG. 3, of a decorative key sheet for pushbutton switches according to a second modification of the first embodiment of the present invention.

Second Modification of First Embodiment (FIG. 5)

While in the above-mentioned example of the decorative key sheet 1 the protrusions 4*a* of the film sheet 4 protrude from the surface 3*c* of the operation plate 3, as shown in FIG. 5, in a decorative key sheet 11 according to a second modification, the distal ends of protrusions 12*a* of a film sheet 12 may be flush with the surface 3*c* of the operation, plate 3. With this construction, no force in a shearing direction from a fingertip or the like is applied to the protrusions 12*a*, making the protrusions 12*a* relatively free from deformation by the fingertip or the like. It is also possible for the distal ends of the protrusions to be somewhat recessed from the surface 3*c* of the operation plate 3. With this construction, as in the second modification, no force in a shearing direction from a fingertip or the like is applied to the protrusions, making it possible to prevent deformation of the protrusions by the fingertip or the like. Further, since the recesses of the partition grooves 3*a* are formed to be small, it is possible to easily identify the regions of the depressing operation members 3*b* by the touch of the fingertip; thus not only is it possible to prevent erroneous input, but a nail, fingertip or the like is caught less frequently as compared with the case in which there are no protrusions at all.

Figure 6:
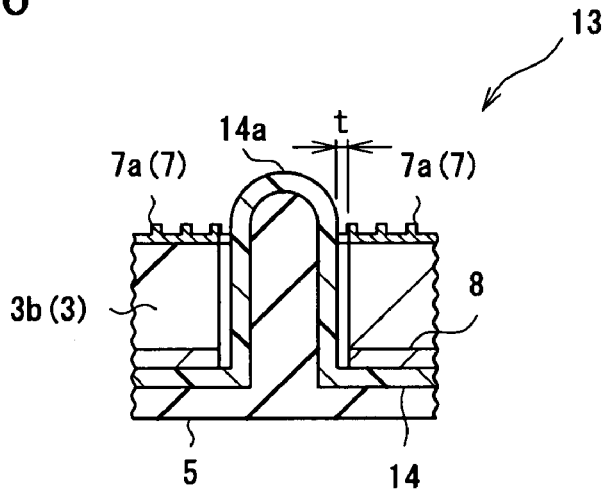
FIG. 6 is a sectional view, corresponding to the region R2 of FIG. 3, of a decorative key sheet for pushbutton switches according to a third modification of the first embodiment of the present invention.

Third Modification of First Embodiment (FIG. 6)

While in the above-mentioned example of the decorative key sheet 1, the protrusions 4*a* of the film sheet 4 are held in intimate contact with the side surfaces of the partition grooves 3*a* of the operation plate 3, as shown in FIG. 6, in a decorative key sheet 13 according to a third modification, it is possible to form a gap t between protrusions 14*a* of a film sheet 14 and the side surfaces of the partition grooves 3*a*. With this construction, the protrusions 14*a* and the depressing operation members 3*b* are separated from each other by the gap t, so, when the depressing operation members 3*b* are depressed, the portion of the film sheet 14 corresponding to the gap t is easily bent, thus making it possible to diminish deformation of the protrusions 14*a*. Thus, the load deforming the protrusions 14*a* is diminished, making it possible to reduce the depression load for the depressing operation members 3*b*.

Figure 7:
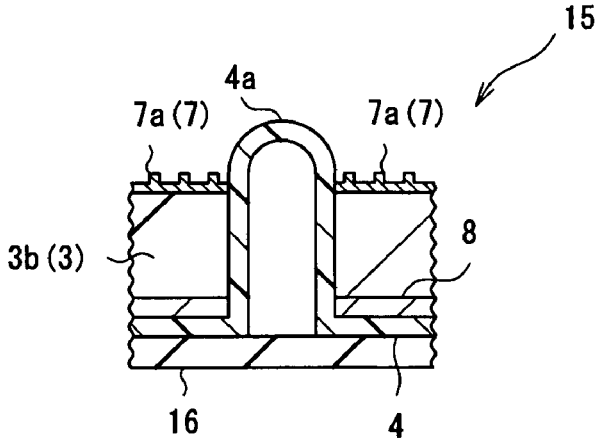
FIG. 7 is a sectional view, corresponding to the region R2 of FIG. 3, of a decorative key sheet for pushbutton switches according to a fourth modification of the first embodiment of the present invention.

Fourth Modification of First Embodiment (FIG. 7)

While in the above-mentioned example of the decorative key sheet 1, the interiors of the protrusions 4*a* of the film sheet 4 are formed as the "solid portions" by the protruding portions 5*a* of the elastic sheet 5, as shown in FIG. 7, in a decorative key sheet 15 according to a fourth modification, it is possible to adopt an elastic sheet 16 having no protruding portions, making the interiors of the protrusions 4*a* hollow. With this construction, the protrusions 4*a* can be flexibly deformed, so the load for deforming the protrusions 4*a* when the depressing operation members 3*b* are depressed is diminished, making it possible to reduce the depression load for the depressing operation members 3*b*.

Figure 8:
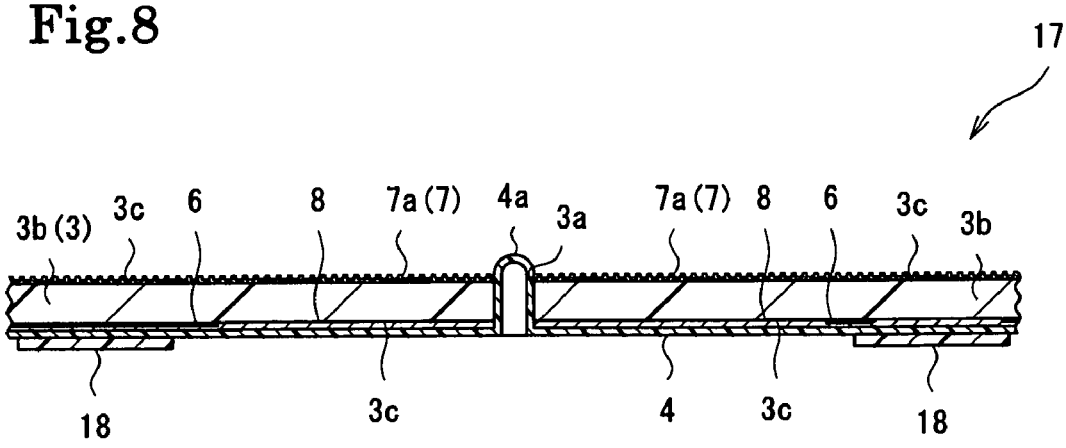
FIG. 8 is a sectional view, corresponding to FIG. 3, of a decorative key sheet for pushbutton switches according to a fifth modification of the first embodiment of the present invention.

Fifth Modification of First Embodiment (FIG. 8)

While the above-mentioned example of the decorative key sheet 1 is equipped with the elastic key sheet 5, as shown in FIG. 8, in a decorative key sheet 17 according to a fifth modification, it is possible to eliminate the elastic sheet, and to provide on the back surface of the film sheet 4 pusher portions 18 for depressing contact switches (not shown) through separate molding. With this construction, as in the fourth modification, the interiors of the protrusions 4*a* can be made hollow, so it is possible to diminish the depression load for the depressing operation members 3*b*.

Figure 9:
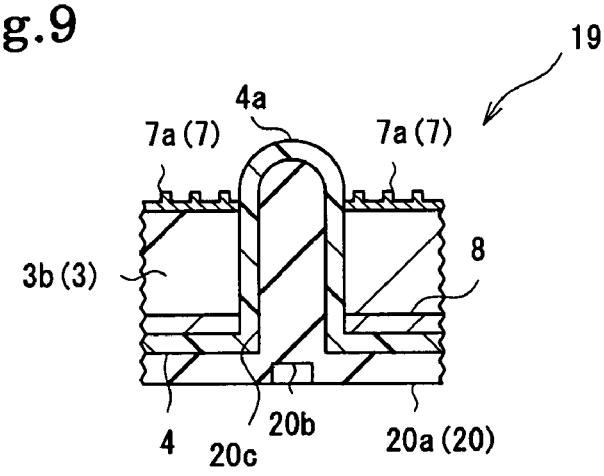
FIG. 9 is a sectional view, corresponding to the region R2 of FIG. 3, of a decorative key sheet for pushbutton switches according to a sixth modification of the first embodiment of the present invention.

Sixth Modification of First Embodiment (FIG. 9)

As shown in FIG. 9, in a decorative key sheet 19 according to a sixth modification, recesses 20*b* directed to a substrate (not shown) can be provided in the portions of a base portion 20*a* of an elastic sheet 20 between the adjacent depressing operation members 3*b*. That is, the recesses 20*b* are provided at positions corresponding to protruding portions 20*c* as "solid portions" filling the spaces in the protrusions 4*a* of the film sheet 4. With this construction, thin portions are formed in the base portion 20*a* between the depressing operation members 3*b*, so the base portion 20*a* is easily deformed at the time of depression of the depressing operation members 3*b*, making it possible to diminish the depression load for the depressing operation members 3*b*.

Figure 10:
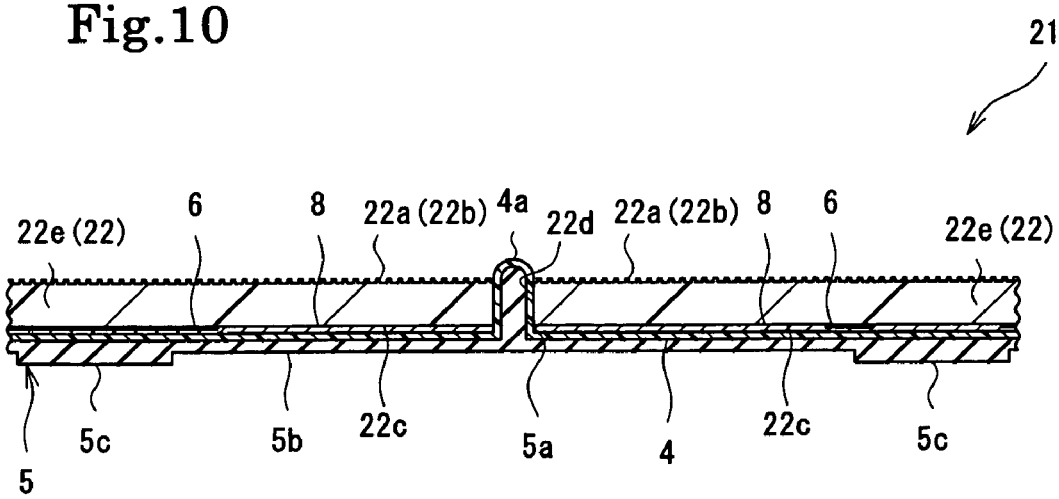
FIG. 10 is a sectional view, corresponding to FIG. 3, of a decorative key sheet for pushbutton switches according to a seventh modification of the first embodiment of the present invention.

Seventh Modification of First Embodiment (FIG. 10)

While in the above-mentioned example of the decorative key sheet 1 the resin layer 7 is provided on the operating surface side surface 3*c* of the operation plate 3, as shown in FIG. 10, in a decorative key sheet 21 according to a seventh modification, it is possible to eliminate the resin layer 7, and form a fine asperity pattern on the operating surface side outer surface of an operation plate 22, making it possible to provide an asperity surface portion 22*a* on a surface 22*b* of the operation plate 22 itself. Further, as in the case of the operation plate 3, the light reflection layer 8 is provided on a back surface 22*c* of the operation plate 22. With this construction, it is possible to omit the resin layer, so the decorative key sheet 21 can be produced easily, making it possible to achieve a reduction in production cost. Further, since the operation plate 22 is formed of resin, when the operator's hand touches the asperity surface portion 22*a* of depressing operation members 22*e* defined by partition grooves 22*d*, injury is not easily incurred, thus enabling the operator to perform input operation safely. In this case, however, it is necessary for the material of the operation plate 22 to be such that the fine asperity pattern formed on the surface 22*b* is not easily flawed, and there is used a material of approximately the same hardness as the material used for the resin layer 7 of the decorative key sheet 1. The asperity surface portion 22*a* having the fine asperity pattern can be formed by pressing the surface 22*b* of the operation plate 22 against a mold, a metal plate, an emboss roll or the like having a fine asperity pattern on the surface thereof.

Figure 11:
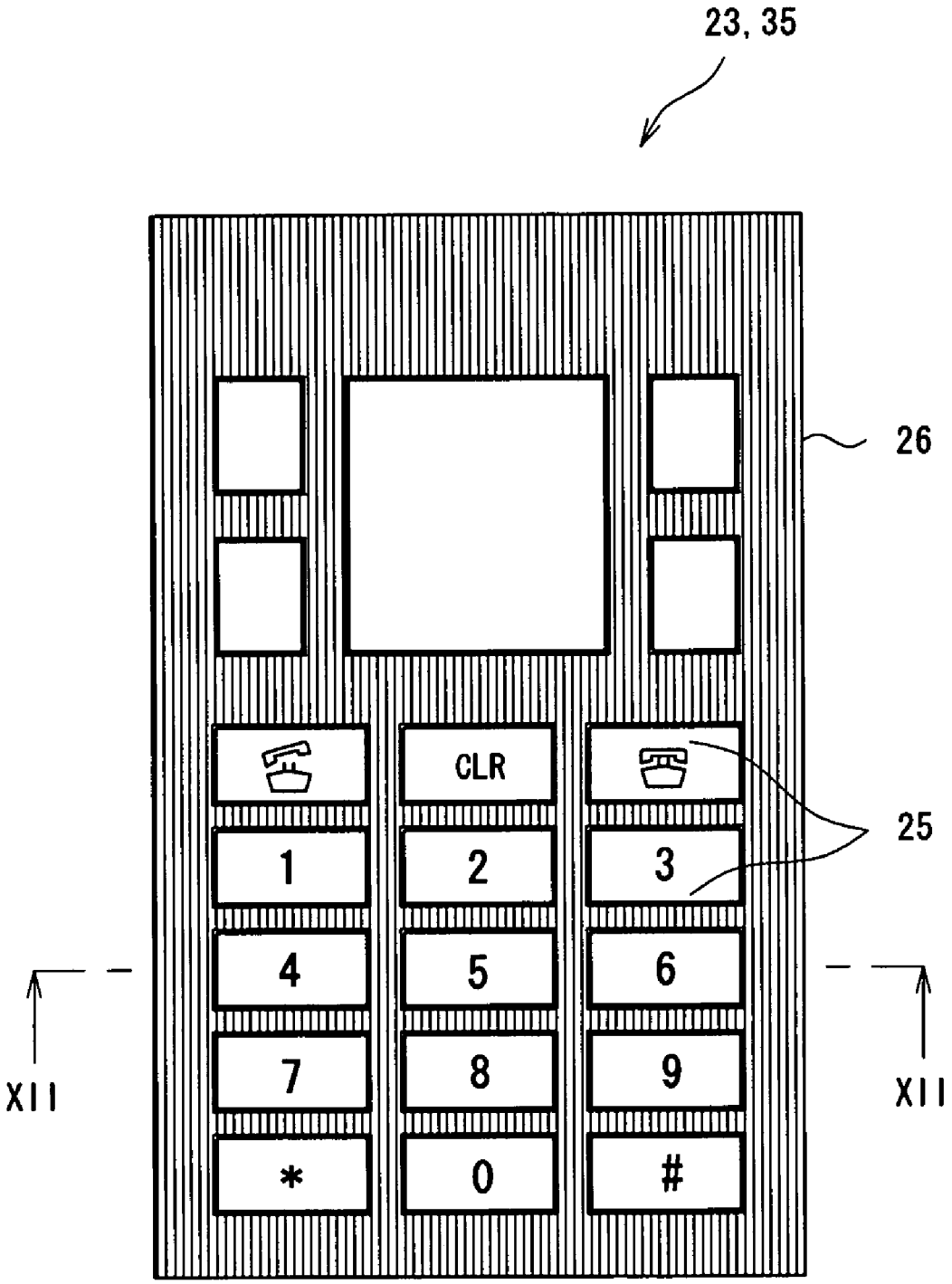
FIG. 11 is a plan view of a decorative key sheet for pushbutton switches according to a second embodiment of the present invention.
Figure 12:
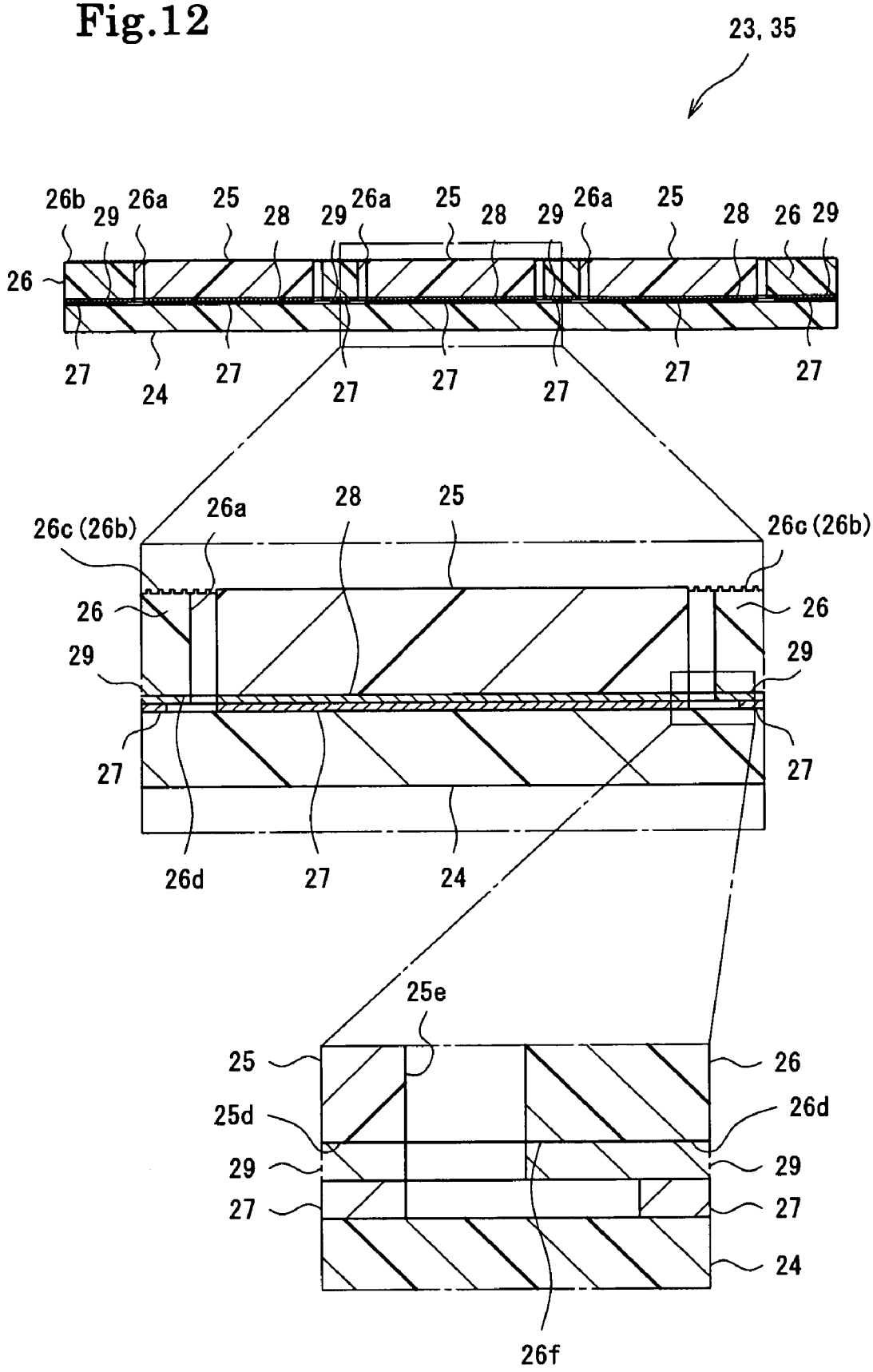
FIG. 12 is a sectional view taken along the line XII-XII of FIG. 11.

Second Embodiment (FIGS. 11 and 12)

FIGS. 11 and 12 show a decorative key sheet 23 according to a second embodiment. FIG. 11 is a plan view of the decorative key sheet 23, and FIG. 12 is a sectional view of the decorative key sheet 23. Like the decorative key sheet 1 of the first embodiment, the decorative key sheet 23 of the second embodiment is used in the cellular phone 2 shown in FIG. 1 so as to be exposed through the operation opening 2*a* having no partition frame.

The decorative key sheet 23 has, on a film-like base sheet 24, key tops 25 formed as films like the base sheet 24 and constituting the operating portions of pushbutton switches, and a frame sheet 26 formed likewise as a film and serving as a "light transmitting sheet" situated between the key tops 25; fixation by print bonding layers 27 is effected between the key tops 25 and the base sheet 24 or between the frame sheet 26 and the base sheet 24, with the entire decorative sheet 23 being formed as a thin sheet. Display layers 28 representing symbols, figures, etc. are provided on the back surfaces of the key tops 25.

As shown in FIG. 12, the print bonding layers 27 existing between the key tops 25 and the base sheet 24 are provided over the entire back surfaces 25*d* of the key tops 25, and are formed to be flush with side surfaces 25*e* of the key tops 25. On the other hand, the print bonding layer 27 provided between the frame sheet 26 and the base sheet 24 does not extend up to the outer edge 26*f* of the frame sheet 26. Thus, there is no print bonding layer 27 at the outer edge 26*f*, thus generating a gap where the frame sheet 26 and the base sheet 24 are not fixed to each other. Further, this gap constitutes a non-constraint region where the base sheet 24 is not constrained by the frame sheet 26.

The key tops 25 constitute portions on whose back surfaces 25*d* there are provided the display layers 28 for displaying symbols, figures, etc. and which are depressed by the finger or the like to effect input operation on the pushbutton switches. In view of the demand for a reduction in thickness of the entire decorative key sheet 23, it is desirable for the thickness of the key tops 25 to be approximately 0.2 mm to 0.6 mm; in an embodiment, their thickness may be approximately 0.4 mm.

The frame sheet 26 is provided for the purpose of retaining the configuration of the decorative key sheet 23 as a whole together with the base sheet 24, preventing excessive rising of the key tops 25, and protecting the bonded portions between the key tops 25 and the base sheet 24. It is a single transparent sheet-like resin film having through-holes 26*a* through which the key tops 25 are exposed. On the surface 26*b* of the frame sheet 26, there is formed a fine asperity pattern by an asperity surface portion 26*c*. As in the first embodiment, the interval of the recesses of the asperity surface portion 26*c* preferably ranges from 10 μm to 500 μm, and the depth of the recesses preferably ranges from 1 μm to 200 μm. More preferably, the depth of the recesses ranges from 5 μm to 100 μm. Further, a black decorative auxiliary layer 29 formed of a polymer coating film is provided on the back surface 26*d* of the frame sheet 26. From the viewpoint of attaining harmony with the key tops 25, the thickness of the frame sheet 26 ranges from approximately 0.2 mm to 0.5 mm; in an embodiment, its thickness may be approximately 0.3 to 0.35 mm.

In the case of a so-called illumination type key sheet, in which light is emitted from a light source such as an LED provided inside a cellular phone to illuminate display portions representing characters, symbols or the like, the decorative auxiliary layer on the back surface of the frame sheet may be formed as a lightproof layer in order to prevent light leakage from the frame sheet (light transmitting resin sheet). In the case in which a black lightproof decorative auxiliary layer is provided on the back surface of the frame sheet, due to the fine asperity pattern, which is easy to see from the front side, it is possible to provide a decorative key sheet of quality appearance which is not simply black but exhibits a hairline pattern upon which transmission, refraction, reflection, interference, scattering, etc. of light are effected.

The base sheet 24 retains the configuration of the entire decorative sheet 23 together with the frame sheet 26, and serves as a base portion upon which the key tops 25 and the frame sheet 26 are placed; further, when the key tops 25 are depressed, the base sheet 24 is slightly distorted to depress contacts provided on a circuit board (not shown). From the viewpoint of a demand for a reduction in thickness, the thickness of the base sheet 24 is preferably 150 μm or less, and more preferably, 50 μm or less. In an embodiment, the base sheet 24 may be formed in a thickness of approximately 50 μm. It is also possible to provide, on the surface of the base sheet 24 which is opposite to the surface where the key tops 25 are provided, pusher-like swellings at the portions depressing the contact electrodes in accordance with the configuration of the printed board (not shown) opposed thereto. While it is possible for both the base sheet 24 and the frame sheet 26 to be formed of a resin film of the same material, it is desirable for the thickness of the base sheet 24 to be smaller than that of the frame sheet 26.

The print bonding layers 27 are adhesive layers for effecting bonding between the key tops 25 and the base sheet 24 and between the frame sheet 26 and the base sheet 24.

The materials of the components of the decorative key sheet 23 will be described.

The base sheet 24, the key tops 25, and the frame sheet 26 are formed from resin films. Examples of the resin to be used include a polyethylene terephthalate resin, a polybutylene terephthalate resin, a polyurethane resin, a polyamide resin, a polypropylene resin, a polystyrene resin, a polycarbonate resin, a polytetrafluoroethylene resin, and a polyvinyl chloride resin.

It is desirable for the print bonding layers 27 to be formed of a polymer material which is softened or melted by heating to exert adhesion force; examples of the material to be used include resins such as an acrylic resin, a vinyl chloride resin, a polyester resin, and a urethane resin, wax, and rubber. From the viewpoint of restraining sagging and deformation of the print bonding layers 27 in the bonding step due to heating and pressurization, it is more desirable to use the type of material which is softened by heating rather than the type which is melted. The ink used for printing may be one which exhibits fluidity enough to allow printing at the time of coating and maintains the solid state thereafter; it is possible to use a solvent dilution type ink which is dissolved or dispersed in solvent, or an ink of the type which is in the solid state at room temperature and which is melted by heating to become liquid. It is desirable to use a solvent dilution type ink since it allows fine, highly accurate printing on predetermined bottom surfaces of the key tops 25, etc. and helps to maintain the printed form, the solvent being evaporated immediately to leave the ink in the solid state.

An example of the method of manufacturing the decorative key sheet 23 will be described. First, the display layers 28 are formed by printing on one surface of a transparent film, and then the key tops 25 are formed by blanking. On the other hand, the fine asperity pattern is transferred to one surface of a transparent film through heating and pressurization with an emboss roll, and the decorative auxiliary layer 29 is formed by printing on the other surface thereof; then, the through-holes 26*a* through which the key tops 25 are to be exposed are formed by blanking to thereby form the frame sheet 26. Next, the print bonding layers 27 are formed on the display layers 28 of the key tops 25 and the decorative auxiliary layer 29 of the frame sheet 26. Finally, the print bonding layers 27 of the key tops 25 and the frame sheet 26 are opposed to the base sheet 24, and the key tops 25 and the frame sheet 26 are fixed to the base sheet 24 through heating and pressurization, whereby the decorative key sheet 23 can be obtained. While in this embodiment the fine asperity pattern is formed on the frame sheet 26 by using an emboss roll on a film sheet, it is also possible to use a mold or a metal plate instead of the emboss roll. It is also possible to form the fine asperity pattern by using an emboss roll when drawing resin into a film.

The effects of the decorative key sheet 23 will be described. The decorative key sheet 23 includes the base sheet 24, the key tops 25, the frame sheet 26, and the print bonding layers 27; it is formed as a thin key sheet allowing proper depression of the key tops 25; further, since the fine asperity pattern is provided on the surface 26*b* of the frame sheet 26, the design of the fine asperity pattern can be visually recognized with clarity. Further, the fingerprint, sebum or the like of the finger of the operator does not easily adhere to the asperity surface portion 26*c* constituting the fine asperity pattern, so it is possible to restrain deterioration in quality due to staining. Further, since the decorative auxiliary layer 29 enhancing the visibility of the fine asperity pattern is provided on the back surface 26*d* of the frame sheet 26, it is possible to prevent wear and separation of the decorative auxiliary layer 29 due to contact with the operator's hand or the like. Further, since the frame sheet 26 is transparent, the color, etc. of the decorative auxiliary layer 29 provided on the back surface 26*d* thereof can be visually recognized to a sufficient degree through the fine asperity pattern, thus making it possible to realize a novel design of quality appearance.

Since the fine asperity pattern is formed on the surface 26*b* of the frame sheet 26 formed of a film, the decorative key sheet 23 can be produced easily, making it possible to achieve a reduction in production cost.

Between the base sheet 24 and the key tops 25, the print bonding layers 27 form side surfaces substantially flush with the side surfaces of the key tops 25, so there is no gap between the key tops 25 and the base sheet 24, making it possible to fix the key tops 25 firmly to the base sheet 24. Thus, a nail tip or the like does not easily get caught, making it possible to make the key tops 25 relatively free from detachment.

Since the print bonding layers 27 are formed on the bottom surface of the frame key sheet 26 except for the outer edge side adjacent to the key tops 25, there is generated a gap having no print bonding layer 27 on the portion of the frame sheet 26 on the outer edge side adjacent to the key tops 25, and this portion constitutes a non-constraint region when the key tops 25 are depressed. Thus, depressing operation can be performed reliably on the key tops 25. That is, a non-constraint region exists around the key tops 25, so, on the base sheet 24 supporting the key tops 25, there extends a region corresponding to the gap portion not constrained by the print bonding layers 27, and the base sheet 24 is deflected easily. Thus, the depression stroke for the key tops 25 can be made long, thereby making it possible to perform accurate key input operation.

Figure 13:
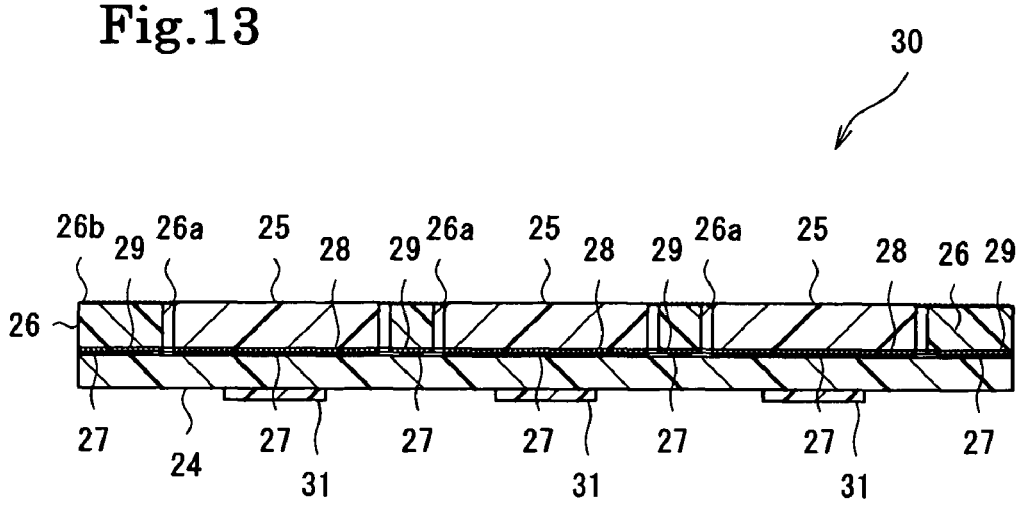
FIG. 13 is a sectional view, corresponding to FIG. 12, of a decorative key sheet for pushbutton switches according to a first modification of the second embodiment of the present invention.

First Modification of Second Embodiment (FIG. 13)

While in the decorative key sheet 23 described above no pushers are provided, in a decorative key sheet 30 according to a first modification, pushers 31 for depressing contact switches (not shown) can be provided, as shown in FIG. 13, on the back surface of the base sheet 24 through separate molding.

Figure 14:
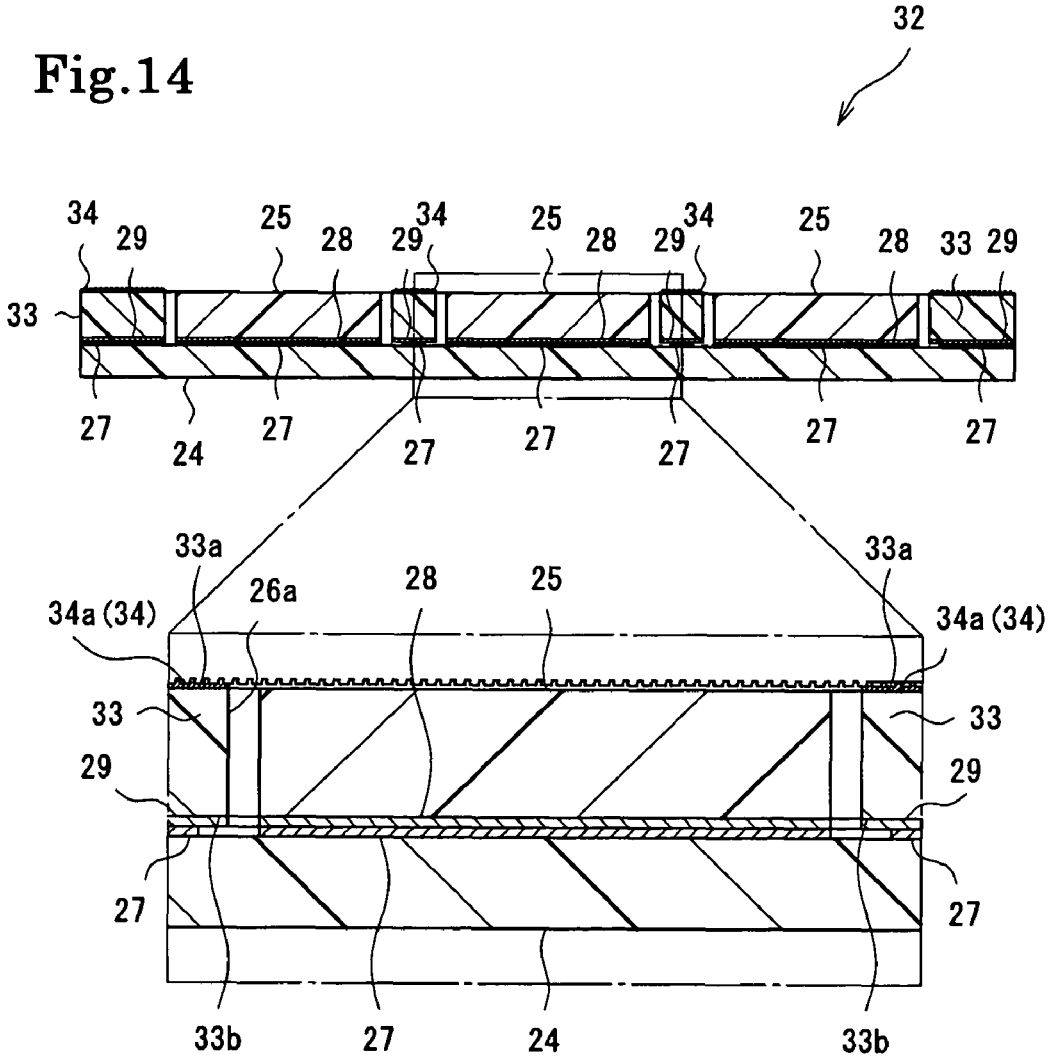
FIG. 14 is a sectional view, corresponding to FIG. 12, of a decorative key sheet for pushbutton switches according to a second modification of the second embodiment of the present invention.

Second Modification of Second Embodiment (FIG. 14)

While in the decorative key sheet 23 described above the fine asperity pattern is formed by the asperity surface portion 26*c* on the surface 26*b* of the frame sheet 26, as shown in FIG. 14, in a decorative key sheet 32 according to a second modification, it is possible to form the surface 33*a* of a frame sheet 33 as a flat surface, and to provide a resin layer 34 on the surface 33*a*, forming a fine asperity pattern by an asperity surface portion 34*a* on the outer surface of the resin layer 34. As in the frame sheet 26, a decorative auxiliary layer 29 is provided on the back surface 33*b* of the frame sheet 33.

Third Modification of Second Embodiment

While in the decorative key sheet 23 the fine asperity pattern is formed by the asperity surface portion 26*c* on the surface 26*b* of the frame sheet 26, it is also possible to form a fine asperity pattern on the surfaces of the key tops. Further, it is also possible to form fine asperity patterns on the surfaces of both the frame sheet and the key tops.

Fourth Modification of Second Embodiment

While in the decorative key sheet 23 the decorative auxiliary layer 29 is provided on the entire back surface 26*d* of the frame sheet 26, it is also possible to form on the back surface 26*d* of the frame sheet 26 a portion where no decorative auxiliary layer is provided, thus obtaining a portion which exhibits high recognition property for the fine asperity pattern and a portion which does not.

Fifth Modification of Second Embodiment

While in the decorative key sheet 23 the black decorative auxiliary layer 29 formed of a polymer coating film is provided, in a decorative key sheet 35 according to a fifth modification, it is possible to provide a light reflection layer 29 having a metallic luster. This makes the fine asperity pattern easier to see, and, synergistically with the light diffusion at the asperity surface portion 26*c* of the fine asperity pattern, it is possible to realize a metallic hairline pattern.

Finally, modifications common to the first and second embodiments will be described.

First Modification Common to Embodiments (FIG. 15)

Figure 15A:
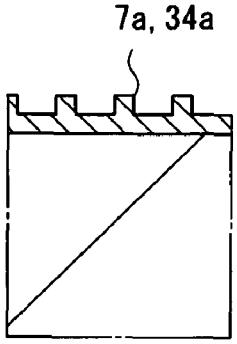
FIG. 15 is a schematic sectional view of fine asperity patterns according to modifications common to the embodiments of the present invention.
Figure 15B:
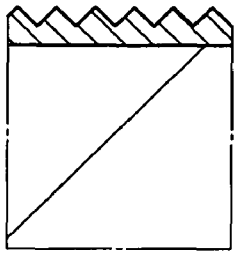
Figure 15C:
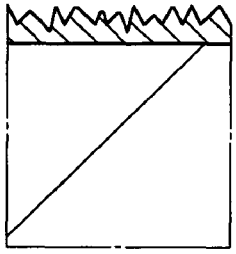

While, in the decorative sheet 1, 9, 11, 13, 15, 17, 19, 21, 23, 30, 32, 35, as shown in FIG. 15(A), the asperity surface portion 7*a*, 22*a*, 26*c*, 34*a* is formed by recesses and protrusions having a rectangular sectional configuration, as shown in FIG. 15(B), in a first modification, it may be formed by recesses and protrusions having a V-shaped or a U-shaped sectional configuration. Further, as shown in FIG. 15(C), it may be formed by recesses and protrusions of an irregular configuration.

Second Modification Common to Embodiments

In the decorative sheet 1, 9, 11, 13, 15, 17, 19, 21, 23, 30, 32, 35, it is also possible to provide a protective layer on the upper surface of the asperity surface portion 7*a*, 22*a*, 26*c*, 34*a*. With this construction, the asperity surface portion 7*a*, 22*a*, 26*c*, 34*a* is not easily flawed, making it possible to maintain the quality of the design. Instead of filling the recesses of the fine asperity pattern, it is desirable for this protective layer to be provided so as to be in conformity with the surface configuration of the fine asperity pattern.

Figure 16:
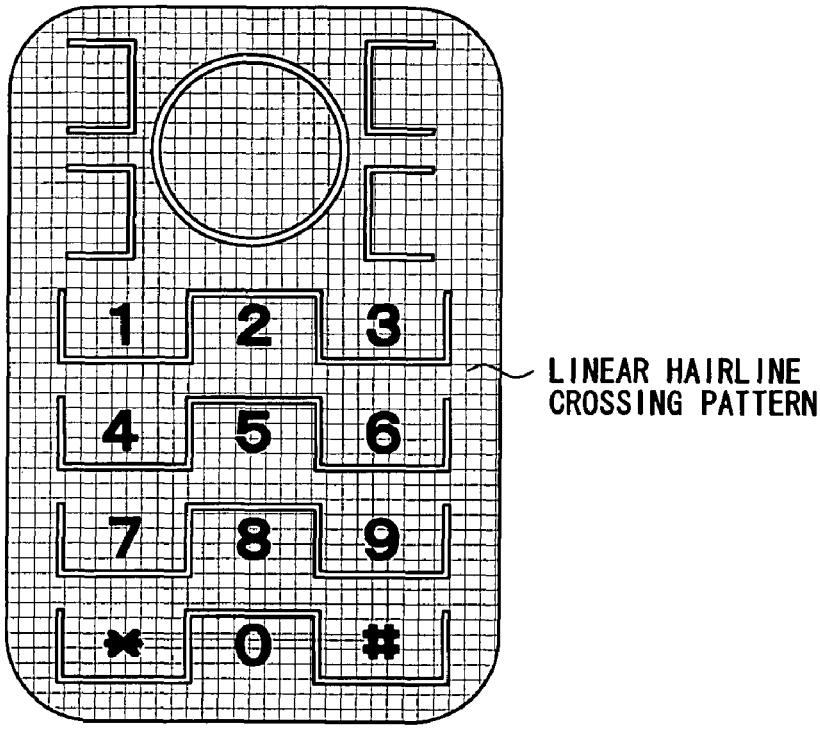
FIG. 16 is a plan view of a decorative key sheet for pushbutton switches according to the present invention, showing a linear hairline crossing pattern.

Third Modification Common to Embodiments (FIG. 16)

In the decorative sheet 1, 9, 11, 13, 15, 17, 19, 21, 23, 30, 32, 35, it is possible to form, in addition to the fine asperity pattern due to the asperity surface portion 7*a*, 22*a*, 26*c*, 34*a*, a fine asperity pattern due to an asperity surface portion on the back side of the operation plate or the frame sheet as the "light transmitting sheet". As shown, for example, in FIG. 16, this enables three-dimensional crossing of the linear hairline patterns, thus making it possible to realize a novel design.

Figure 17:
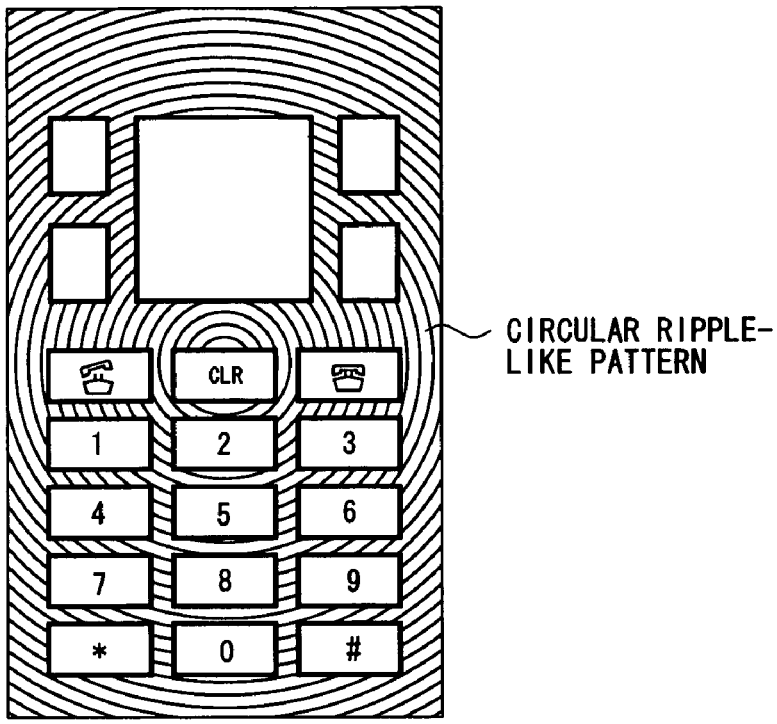
FIG. 17 is a plan view of a decorative key sheet for pushbutton switches according to the present invention, showing a circular ripple-like pattern.
Figure 18:
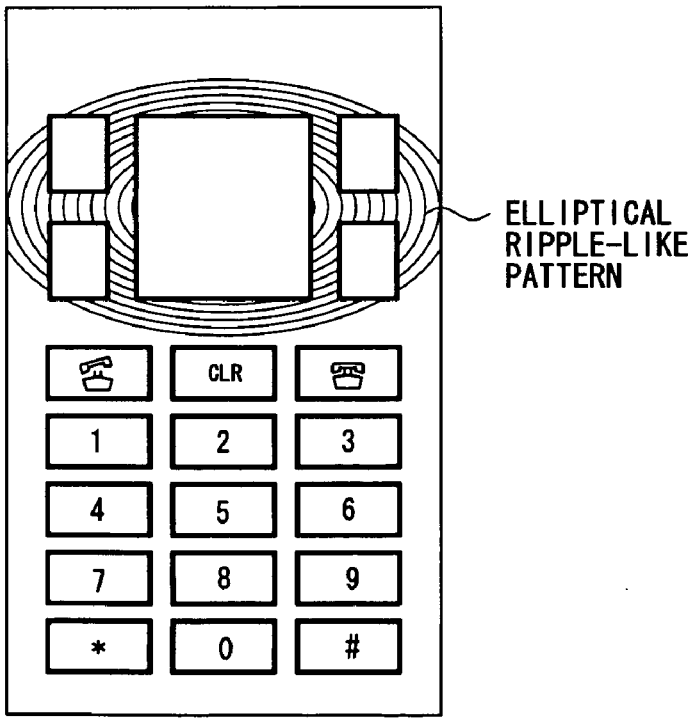
FIG. 18 is a plan view of a decorative key sheet for pushbutton switches according to the present invention, showing an elliptical ripple-like pattern.

Fourth Modification Common to Embodiments (FIGS. 17 and 18)

While in the decorative sheet 1, 9, 11, 13, 15, 17, 19, 21, 23, 30, 32, 35 the fine asperity pattern is a linear hairline pattern as described above, it is also possible, for example, to provide a circular ripple-like pattern as shown in FIG. 17 or an elliptical ripple-like pattern as shown in FIG. 18 in a part of the operation plate 3, 10, 22 or the frame sheet 26, 33 as the "light transmitting sheet".

EXAMPLES

There were produced a decorative key sheet (35) according to the second embodiment and a decorative key sheet according to a comparative example which, unlike the decorative key sheet (35), had the fine asperity pattern on the back side of the frame sheet. First, a fine asperity pattern whose recess interval was 200 μm and whose recess depth was 50 μm was provided on a resin film of polycarbonate resin with a thickness of 300 μm by means of an emboss roll. There were produced a frame sheet I in which aluminum was deposited by evaporation to a thickness of 100 nm on the side opposite to the asperity surface portion with the fine asperity pattern to form a decorative auxiliary layer (29), and a frame sheet II in which aluminum was deposited to a thickness of 100 nm on the asperity surface portion to form a decorative auxiliary layer. On the other hand, key tops (25) of a predetermined configuration formed of polycarbonate resin and having a thickness of 400 μm and the frame sheet I or the frame sheet II mentioned above were placed on and fixed to a base sheet (24) having a thickness of 50 μm and formed of polyurethane resin through the intermediation of a print bonding layer (27) of polyurethane resin having a thickness of 10 μm. At this time, the frame sheet I was fixed such that the asperity surface portion appeared on the surface, and the frame sheet II was fixed such that the asperity surface portion was fixed to the print bonding layer. In this way, there were obtained a decorative key sheet (35) according to the present invention containing the frame sheet I, and a decorative key sheet according to a comparative example containing the frame sheet II.

The decorative key sheet (35) and the decorative key sheet of the comparative example thus obtained were placed on a desk, and five persons were asked about what they thought of the surface conditions of the two decorative key sheets. Four persons stated that the fine asperity pattern was more clearly visible in the decorative key sheet (35) of the present invention, and the remaining one person stated that the fine asperity pattern was more clearly visible in the decorative key sheet of the comparative example.

What is claimed is:

1. A decorative key sheet for pushbutton switches, comprising:

a fine asperity pattern due to an asperity surface portion on an operating surface side of a light transmitting sheet; and a decorative auxiliary layer enhancing a visibility of the fine asperity pattern on a surface on the side of the light transmitting sheet opposite to the operating surface, wherein the light transmitting sheet includes an operation plate provided with a partition groove defining a depressing operation member allowing depressing displacement, and a film sheet provided with a protrusion swelling toward the partition groove from the side opposite to the operating surface of the operation plate.

2. A decorative key sheet for pushbutton switches according to claim 1, further comprising a light transmitting resin layer on the operating surface side surface of the light transmitting sheet, wherein the fine asperity pattern formed by an asperity surface portion is provided on an outer surface of the light transmitting resin layer.

3. A decorative key sheet for pushbutton switches according to claim 1, further comprising a fine asperity pattern, formed by an asperity surface portion, on the operating surface side outer surface of the light transmitting sheet.

4. A decorative key sheet for pushbutton switches according to claim 1, wherein the decorative auxiliary layer is formed as a light reflecting layer having a metallic luster.

5. A decorative key sheet for pushbutton switches according to claim 1, wherein the protrusion protrudes from the outer surface of the operation plate.

6. A decorative key sheet for pushbutton switches according to claim 1, wherein the protrusion is formed as a solid portion formed of a rubber-like elastic material.

7. A decorative key sheet for pushbutton switches according to claim 1, wherein the depressing operation member is defined by an annular partition groove.

8. A decorative key sheet for pushbutton switches according to claim 1, wherein a gap is provided between the protrusion and a side surface of the partition groove.

9. A decorative key sheet for pushbutton switches according to claim 1, further comprising an elastic sheet formed of a rubber-like elastic material on a back surface of the film sheet.

10. A decorative key sheet for pushbutton switches according to claim 9, wherein a recess is provided in a base portion of the elastic sheet at a position between depressing operation members adjacent to each other.

11. A decorative key sheet for pushbutton switches comprising: a fine asperity pattern due to an asperity surface portion on an operating surface side of a light transmitting sheet; and a decorative auxiliary layer enhancing a visibility of the fine asperity pattern on a surface on the side of the light transmitting sheet opposite to the operating surface;

a base sheet including a key top and a resin film, the light transmitting sheet comprising a frame sheet arranged on the base sheet side by side with the key top; and a print bonding layer formed as a print layer and formed of a cured body brought into contact with one of the key top, the frame sheet, and the base sheet in one of a softened state and a molten state.

12. A decorative key sheet for pushbutton switches according to claim 11, wherein the print bonding layer exhibits, between the base sheet and the key top, a side surface which is substantially flush with a side surface of the key top.

13. A decorative key sheet for pushbutton switches according to claim 11, wherein the print bonding layer is formed on the bottom surface of the frame sheet except for an outer edge side thereof adjacent to the key top.

14. A decorative key sheet for pushbutton switches according to claim 11, further comprising a light transmitting resin layer on the operating surface side surface of the light transmitting sheet, wherein the fine asperity pattern formed by an asperity surface portion is provided on an outer surface of the light transmitting resin layer.

15. A decorative key sheet for pushbutton switches according to claim 11, further comprising a fine asperity pattern, formed by an asperity surface portion, on the operating surface side outer surface of the light transmitting sheet.

16. A decorative key sheet for pushbutton switches according to claim 11, wherein the decorative auxiliary layer is formed as a light reflecting layer having a metallic luster.

* * * * *